United States Patent [19]

Brück et al.

[11] 4,407,867

[45] Oct. 4, 1983

[54] APPARATUS AND A METHOD FOR THE COMPLETELY AUTOMATIC LACQUERING OF STRIP-FORM MATERIALS

[75] Inventors: Herbert Brück; Günter H. Steinbüchel, both of Leverkusen; Hans Hofmann, Cologne; Josef Busch, Bergisch Gladbach; Franz Hoffacker, Langenfeld, all of Fed. Rep. of Germany

[73] Assignee: Agfa-Gevaert Aktiengesellschaft, Leverkusen, Fed. Rep. of Germany

[21] Appl. No.: 215,377

[22] Filed: Dec. 11, 1980 (Under 37 CFR 1.47)

[30] Foreign Application Priority Data

Dec. 21, 1979 [DE] Fed. Rep. of Germany ..... 2951802

[51] Int. Cl.[3] ..... B05D 1/28; B05D 3/12; B05C 1/00; B05B 5/00

[52] U.S. Cl. ..... 427/365; 118/235; 118/236; 118/249; 118/642; 118/643; 118/672; 118/681; 427/428

[58] Field of Search ..... 118/235, 236, 249, 641, 118/642, 643, 668, 672, 681; 427/54.1, 55, 365, 428

[56] References Cited

U.S. PATENT DOCUMENTS

| | | | |
|---|---|---|---|
| 2,612,589 | 9/1952 | Jones et al. | 118/642 X |
| 3,207,125 | 9/1965 | Strandberg | 118/672 X |
| 3,364,587 | 1/1968 | Norton et al. | 118/641 X |
| 3,862,553 | 1/1975 | Schwemmer et al. | 118/672 X |
| 4,261,288 | 4/1981 | Jurascheck et al. | 118/642 |

*Primary Examiner*—Michael R. Lusignan
*Attorney, Agent, or Firm*—Connolly and Hutz

[57] ABSTRACT

The invention relates to an apparatus and a method for the completely automatic lacquering of strip-form materials, whereby at least one unwinding device is provided with a fast running positioning device, an application roller and an opposing pressure roller are designed in such a way that they grasp the strip-form material and push it centered through the dryer and through a guide device and a winding up device is provided with at least one receiving spool which catches the strip-form material and winds it up.

10 Claims, 4 Drawing Figures

FIG. 1
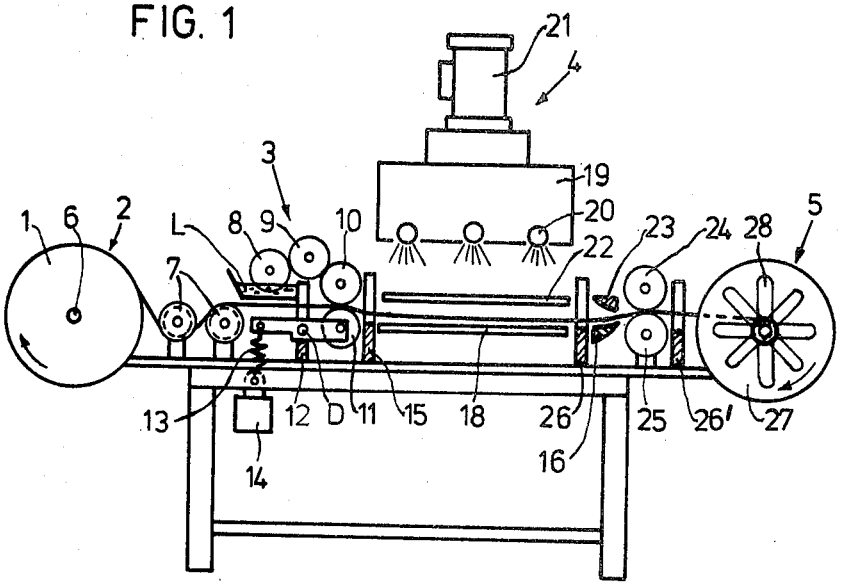
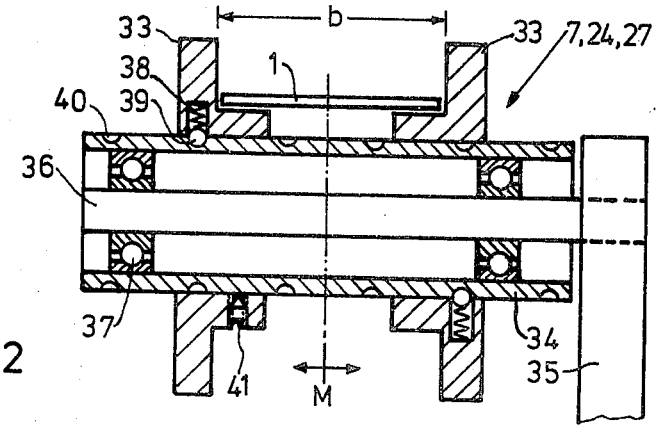
FIG. 2

APPARATUS AND A METHOD FOR THE COMPLETELY AUTOMATIC LACQUERING OF STRIP-FORM MATERIALS

The invention comprises an apparatus and a method for the lacquering of strip-form materials, in particular of photographic film or paper surfaces, the apparatus consisting of at least one unwinding device, an applicator, a dryer and at least one winding device.

It is known to provide strip-form materials with a protective layer to protect the surface. Protective layers of this type can be applied by various methods, thus, for example, by casting, spraying, printing or coating. After applying the protective layer to a strip-form material, the protective layer has to be dried completely so that it does not adhere to the next windings in the roll as it is wound up. Heated air, radiation heat such as infrared radiation or even heated drums over which the coated strip is guided by its reverse side can be used for drying the protective layers.

The time for drying these protective layers is relatively long as the solvent in the protective layer must have evaporated without leaving a residue. Lacquers consisting of, for example, acrylic acid, methacrylic acid or of vinyl polymers are also known which can be made to be cured by polymerisation using ultraviolet radiation. These lacquers require much shorter drying and curing times between the application of the lacquer and the winding of the strip provided with the protective lacquer.

The known methods and apparatuses for applying a protective lacquer to strip-form materials have the disadvantage that the strips at least when they are first inserted into a lacquering apparatus have to be threaded through since the apparatus is provided at considerable cost with complicated devices which allow the strip to be guided through the entire apparatus from being unwound to being wound up.

It is also known to avoid the threading of each individual strip by sticking the beginning of the strip of one roll to the end of the strip of the previous roll after threading the first strip. The apparatus has to be stopped for this purpose in order to perform the adhesion stage or the apparatus has to be provided with a strip store between the unwinding device and the coating device, from which the apparatus is supplied during the adhesion process. For fast running strips, a store must be designed sufficiently large so as to obtain the time needed for adhesion.

All known apparatuses usually have one or even more of the following disadvantages, such as

- time consuming threading with prolonged stoppage of the apparatus so that losses of strip material occur since the strip cannot be coated from the beginning;
- technical and financial outlay for the material store, particularly in the case of fast-running machines;
- high outlay for automatic adhesion apparatuses; cutting out of the adhered points with corresponding losses before rolling the strips in order to split up the rolls again.

Although there is a considerable need for an automatically and economically operating apparatus which can be produced inexpensively for lacquering strip-form materials, it has not been possible in the past to provide an apparatus of this type. An apparatus which is of particular importance, for example, is one for the two-sided coating of film surfaces with a protective lacquer or the lacquering of coloured pictures once they have been produced in the film laboratory, in order to make the mechanically sensitive surfaces insensitive to scratches and also to protect the emulsion layers of the coloured pictures from the grease and moisture produced by finger prints or from liquids such as coffee, ink or even nail varnish remover which may get on the surface in households.

The object of the invention is to find a method and an apparatus which allow strip-form materials to be introduced from rolls into the apparatus, to be coated at high speed, to be dried and to be wound into rolls with minimum stoppage of the apparatus.

The object is achieved according to the invention in that the unwinding device is provided with a fast running positioning device for rolls of strip-form material, in that a application roller and an opposing pressure roller of the applicator is designed in such a way that the rollers seize the strip-form material and push it, centered, through the drying device and through a guide device and in that the winding device is provided with at least one collecting spool which receives the strip-form material and winds it up.

The invention also relates to a method which achieves the object of the rapid completely automatic lacquering of strip-form materials, in particular of photographic films and papers, in that the beginning of the strip-form material is inserted into a lacquer application device, the applicator seizes the strip-form material by means of an application roller and an opposing pressure roller and the strip-form material is fed, centered, through a drying apparatus and through a centering roller for the automatic winding of a collecting spool of a winding device.

This simple method and the simple apparatus surprisingly allow strip-form materials to be inserted rapidly and without difficulty into the apparatus. The application device takes the beginning of the strip, guides it through the apparatus to the winding device in order to start winding it and to wind it up automatically. During its rapid passage to the apparatus, the strip-form material is provided with the lacquer in the application device and dried in a drying device.

For the loss-free lacquering of the strip-form material, the apparatus preferably has a monitoring device immediately downstream of the application device which causes the opposing pressure roller to be pressed against the application roller when the beginning of the strip-form material has just passed the application device.

This device allows simple insertion of the beginning of the strip, and the lacquering and transportation of the strip take place immediately once the beginning edge of the strip has reached the monitoring device, for example a photocell with a transmitter and receiver.

The centering and conveying of the strip take place in a simple manner in that the opposing pressure roller is mounted in two individually movable arms and springs are provided on the arms which press the opposing application roller against the application roller and in that a lifting magnet which can be controlled by the monitoring device and holds the rollers apart for the introduction of the strip is provided.

This advantageous device allows the strip-form material to be pushed through the drying section to the centering spool at the end of the drying section without touching the coated surface and the edges of the strip.

As the strip-form material rolls somewhat after the application of the lacquer, it is itself rigid. A change in direction during entry into the application device is automatically corrected by the special mounting of the opposing pressure roller on individual, freely movable arms each pressing the roller by means of a spring. This self-controlling system is surprisingly solid and guides the strip-form material freely in widths of up to 1 meter with deviations of less than 2 mm.

According to a particularly advantageous embodiment of the invention, ultraviolet radiators which are arranged in a radiator housing above the drying plate on which the strip-form material is pushed are used for drying and curing the lacquer, a radiator shutter being pivoted more or less between the strip-form material and the radiator, depending on the speed of the strip-form material, and the radiation being kept completely away from the strip-form material during a stoppage.

It has proven advantageous to use as protective layer for the strip-form materials lacquers which cure through polymerisation by means of ultraviolet radiation. The quantity of coating composition applied wet, for example to a photographic material, generally lies in the range between 2 and 20 $cm^3$ per $m^2$ surface area at viscosities of from 0.025 to 1.0 Pa's.

Artifical radiators whose emission lies in the range of from 250 to 500 nm can be used as sources of radiation with which the protective layers applied are cured. Mercury vapour lamps, xenon and tungsten lamps, in particular mercury high pressure lamps are advantageous as ultraviolet radiators.

It has been found that protective layers of this type can be cured in fractions of a second due to the radiation so the apparatus can be operated aconomically at high speeds.

A particular embodiment of the apparatus is distinguished in that guide plates for supplying the strip-form material to a centering roller are arranged downstream of the drying device and in that the centering roller can simultaneously act as opposing roller for a pressure mechanism for rear pressure on the unlacquered side of the strip-form material.

An advantageous winding device for winding up the strip-form material has been found to be one which is distinguished in that a collecting spool is provided and in that the collecting spool is provided on the interiors of the flanges with radially outward arranged receiving springs, the collecting spool being provided with receiving springs projecting increasingly toward the centre of the strip radially to the centre of the collecting spool for automatically receiving and guiding the strip-form material round the core of the collecting spool.

Due to the use of the collecting spools which are known per se in a special embodiment, the beginning of the strip is caught securely and the strip which is pushed by the application device through the apparatus is guided and wound on a winding core.

A particularly economically operating apparatus is achieved in that the winding device is provided with two collecting spools for winding up the strip-form material and in that the collecting spoools can be moved alternately into a winding position and into a discharge position by means of a change-over device.

Thus, an operator can remove the already lacquered roll in the discharge position during the lacquering process once the next roll is being wound in the winding position. As is known, the change-over device can consist of a circular track or of a lifting device which is controlled by the end of the roll and brings the empty collecting spool into the winding position.

The collecting spools are separately driven by electric motors by means of friction devices which, in turn, can be adjusted depending on the desired winding tightness of the rolls. The apparatus operates even more economically when two unwinding devices are also provided which can be arranged rigidly, the strips to be coated being supplied alternately from one unwinding device and then from the other via a deflecting roller to the applicator. The unwinding devices do not need a drive mechanism but merely need simple known braking devices.

With the arrangement of two unwinding devices and two winding devices, it is possible to effect almost continuous operation of the apparatus, the next strip being inserted immediately after the end of the preceding strip has reached the winding device.

One possible application of the apparatus for lacquering strip-form materials of various widths can surprisingly be achieved simply since the flanges of the guide roller of the centering roller and the collecting spool are adjustable in width from the centre out toward both sides.

In order to lacquer photographic papers in rolls which are already provided with pictures, it is possible for an apparatus having a width adjustment of, for example, the conventional formats of 7.6 cm, 8.9 cm, 10.2 cm or 12.7 cm to carry out processing in any sequence without wasting much time. It is also possible to design an apparatus which is suitable for any widths which might occur. The shape adjustment can be designed for certain desired strip widths in such a way that the flanges engage for each shape, for example, with a ball notch device. For strip widths which may occur at random, the flanges can be adjusted continuously to the desired interval and secured in the position on the axis by a screw. However, the invention also comprises an apparatus which simultaneously unwinds, lacquers, dries and winds up several strips which are guided in parallel, adjacent to each other by means of an application device.

It is also advantageous to construct the apparatus in such a way that the speed of lacquering can be selected within wide limits by altering the speed of the application device wherein the unwinding device can be braked by a friction device and the winding up device is provided with its own frictional drive means.

This design of the apparatus allows the speed of lacquering to be selected within wide limits merely by varying the speed of the application device, the thickness of the layer applied remaining constant at all speeds. If necessary the speed can thus also be reduced in a simple manner for insertion of a new strip-form material without a change taking place in the thickness of the lacquer layer.

The apparatus described and the method demonstrate for the first time a possible method of providing strip-form materials with protective layer at high speeds, the individual measures described such as automatic threading, double design of the unwinding and winding up device and the application device as simultaneous drive means for the strip-form material to be lacquered allowing a minimum of stoppages of the apparatus.

Other advantages, features and possible applications can be seen from the following description in conjunction with the attached drawings.

FIG. 1 shows a front view of the apparatus in a design with one winding and unwinding device.

FIG. 2 shows a width adjusting device for the guide roller, centering roller and collecting spool.

Figure 3:
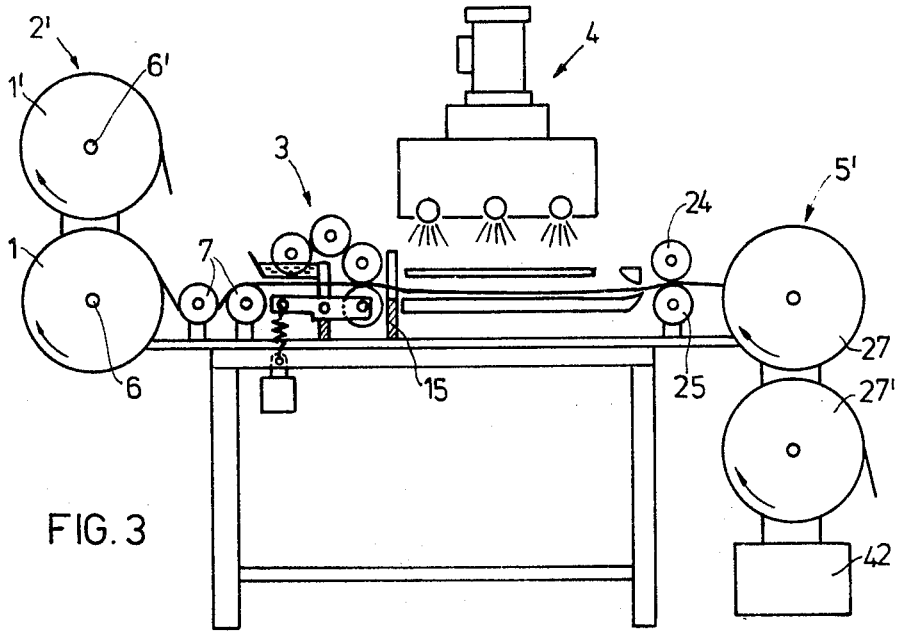
FIG. 3 shows a front view of the apparatus with two winding and two unwinding devices.

FIG. 1 shows a front view of the apparatus in a simple embodiment. A roll of strip-form material 1 which is to be provided with a protective layer is pushed onto a fast running positioning device having an axle 6 and secured. Fast running positioning devices are known structural elements such as, for example, the axle 6 having a somewhat smaller diameter than that of a tube of a roll of strip-form material. After positioning the tube, the diameter is expanded by spreader members fitted into the axle 6 by means of compressed air or the like so that the tube sits firmly on the axle 6. The axle 6 is rotatably mounted and is braked by a brake of a known type so that the strip-form material does not continue running off when the strip speed is reduced. In order to introduce the strip 1 from the roll into a lacquer application device 3, deflecting and guide roller 7 are arranged upstream of the application device 3. The guide roller 7 is shown in FIG. 2. A stationary shaft 36 on which a tubular member 34 can rotate freely on ball bearings 37 is arranged on a support 35. Two flange discs 33 are pushed on the cylindrical surface of the tubular member 34 in such a way that they can be slid axially from the centre M out toward both sides so that the interval b between the flanges 33 can be adapted to any desired width of the strip-form material or the strip 1. The flanges can be fixed on the tubular member 34 at any interval b by means such as screws 41. If the widths b of the strip 1 recur frequently, the tubular member 34 is provided at intervals corresponding to the width b with encircling grooves 40 into which balls 39 resting in the flanges 33 are pressed by springs 38 and arrest the flanges 33 at the predetermined intervals b. The application device 3 (FIG. 1) consists of a scoop roller 8, a transfer roller 9 and an application roler 10. The scoop roller 8 rotates through the lacquer, transfers it to the transfer roller 9 which, in turn, has notch-like indentations which receive the lacquer and apply it to the strip-form material 1. The application roller is provided with a drive menas, usually with an electrical motor which is controllable in speed within wide limits. An opposing pressure roller 11 is driven by the application roller 10 by means of two toothed wheels. The opposing pressure roller 11 is mounted at each end in an arm 12 which is rotatable about pivots D. Each arm 12 is mounted independently to allow centering of the path of the strip-form material 1. Two springs 13 act on the downstream end of the arms 12 and press the opposing pressure roller 11 toward the application roller 10, the strip-form material 1 located between the two rollers 10, 11 being pressed against the application roller 10 and taking up the lacquer. In order to insert the strip-form material into the application device, the springs 13 are released by a lifting magnet 14 so that the opposing pressure roller 11 pivots away from the application roller 10. This pivoting movement does however cover only a small distance of, for example, 1 mm so that the toothed wheels remain in mesh for driving the application roller 10 and opposing pressure roller 11 but the rollers 10, 11 remain sufficiently far apart to prevent contamination of the opposing pressure roller. One monitoring device 15 is arranged upstream of the rollers 10, 11 and one downstream, for example contact switches or photocells and receivers which control the lifting magnet 14 to release the springs 13. Once the beginning of the strip-form material 1 reaches the monitoring device 15 downstream of the rollers 10 and 11 in the direction of travel, the lifting magnet 14 tensions the springs 13 so that the rollers 10, 11 are pressed together to apply the lacquer to the strip-form material 1. Once the end of the strip-form material 1 reaches the monitoring device arranged upstream of the rollers 10, 11 in the direction of travel, the rollers 10, 11 are removed from each other. Due to the close arrangement of the monitoring devices 15 on the rollers 10, 11 only a few centimeters of the strip-form material 1 at the beginning and the end are not lacquered.

From the applicator device 3, the coated strip-form material is pushed via a drying plate 18 through a dryer 4. The dryer 4 consists of a radiation housing 19 which is arranged above the drying plate 18 and in which at least one ultraviolet radiator 20 is arranged. The number of radiators 20 is based on the desired drying time which depends on the thickness of the lacquer layer and the coating speed. When using several radiators 20 for achieving strip speeds of, for example, 50, 100 or more meters per minute, several high capacity radiators 20 which have marked heat evolution in addition to the radiation are needed. A ventilator 21 for cooling the radiators is therefore provided. A radiation shutter 22 is arranged beneath the radiators 20 and releases the radiation to a greater or lesser extent depending on the speed of the strip-form material 1. If the strip happens to come to a standstill the radiation shutter 22 covers the strip completely in order to protect the strip from damage by ultraviolet radiation or heat.

The strip 1 which is dried in this way reaches the guide plates 23 which guides it to a centering roller 24. The centering roller 24 has flanges at both ends which are movable from the centre of the roller out in the axial direction (as described with reference to FIG. 2), wherein the flanges can be adjusted somewhat wider than the respective strip width b. The winding device 5 has a strip collecting spool 27 downstream of the centering roller 24. The strip collecting spool 27 is also provided with movable flanges in the same manner as the centering roller and can be adjusted to the desired strip width b. The width adjusting device for the spool 27 is also designed like that of the guide roller 7 described in FIG. 2. FIG. 1 shows the strip collecting spool 27 without the front flanges. At least three spring-mounted strips of sheet metal or plastics material are arranged radially outwards on the periphery of the strip collecting spool 27 as receiving springs 28. These receiving springs 28 are designed in such a way that the interval b between the flanges become smaller toward the axle, i.e. that the receiving springs 28 on the outer diameter travel a shorter distance inwards from the flanges than on the inner diameter. The receiving springs 28 consist of strips which are spring mounted in the wall of the flanges. The collecting spool 27 is driven by an electric motor by means of a sliding clutch independently of the drive mechanism (not shown) in such a way that the strip-form material is still collected and wound reliably at the highest permitted strip speed. It is also possible to adapt the winding motor for various winding functions by means of step switches or continuous speed adjustment or control if the lacquering operation takes place at greatly differing speeds.

It is often desirable to provide the rear of the strip-form material 1 with a rear print such as the company name, numbers of pictures, numbers of meters or the like. For this purpose, the centering roller 24 can be used as a pressure roller for a printing mechanism 25. Many designs of such printing mechanisms are commercially available for any conceivable purposes and are therefore not described in more detail. A printing mechanism of this type can be controlled by a pair of photocells 26 in such a way that the downstream photocell 26' in the direction of travel of the strip switches on the printing mechanism when the beginning of the strip 1 enters the light beam and the printing mechanism is switched off again when the end of the strip clears the light beam of the photocell 26 lying upstream of the printing mechanism. Other monitoring devices such as microswitches or air jets can be used instead of the photocells.

FIG. 3 shows an apparatus for lacquering strip-form materials 1 which is distinguished by particularly short stoppages. The apparatus has an unwinding device 2' with two unrolling devices for the strip 1. While one strip is unwound from the roll into the apparatus for lacquering purposes a strip roll can be placed onto the unwinding device 2'. The winding up device 5' also has two receiving spools 27, 27'. Once the strip from one roll has passed through and has been wound onto, for example, the receiving spool 27, one of the monitoring devices 15, 26 described above actuates a lifting device 42 which lifts the receiving spool 27 and places an empty receiving spool 27' in its place. The already lacquered strip material can be removed during the lacquering process and one spool with strip material to be lacquered can be placed onto the unwinding device 6'. Thus, in order to operate the apparatus, one person, at most, is needed.

Operation takes place in the following manner; The roll with unlacquered strip-form material 1 is placed onto the fast running positioning device 6, secured and the beginning of the strip inserted round the rollers 7 into the application device 3. The photocell 15 switches on the appliction device 3 which pushes the strip-form material 1 through the dryer 4 over the centering roller 24 to the receiving spool. The collecting spool seizes the strip 1 and winds it up. Lacquering takes place automatically until the strip has run off on the unwinding device. According to FIG. 1, the lacquered roll is taken from the winding up device 5, a next roller of unlacquered strip 1 placed onto the unwinding device and the beginning of the strip guided to the application device. During this procedure, a short stoppage is necessary for exchanging the rolls.

According to FIG. 3, this short stoppage is omitted almost completely since directly after the first roll has run off, the beginning of the strip on the next roll can be supplied and the empty second collecting spool is ready after one second. The roll is positioned and removed during the lacquering process. With this particularly advantageous apparatus it is possible for one person to operate several apparatuses or, for example, to carry out further processing of the lacquered rolls.

Figure 4:
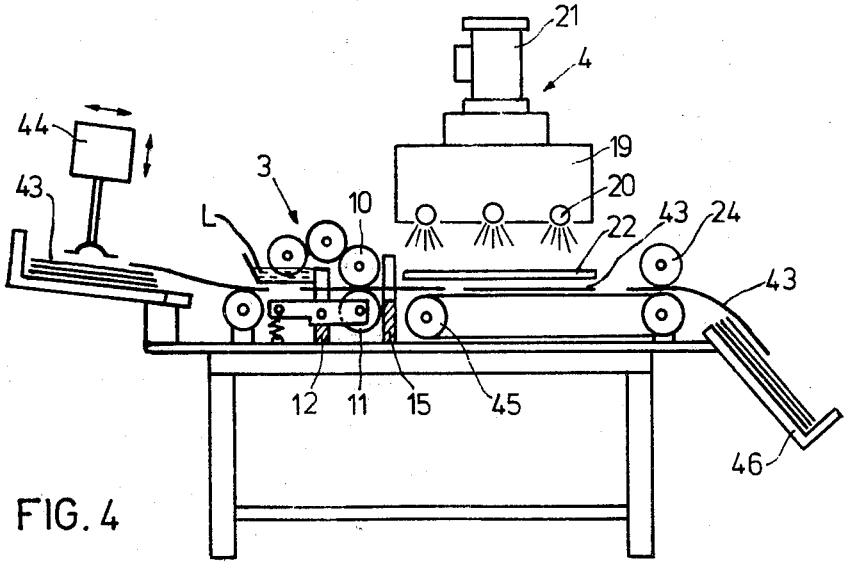
FIG. 4 shows a front view of the apparatus for the processing of sheet-form materials.

The apparatus can also provide individual sheets 43 of, for example, photographic materials with a lacquer layer (FIG. 4). For this purpose, the unwinding device 2 is replaced by a sheet stacking device 44 which unstacks the sheets 43 and introduces them individually into the application device 3. Sheet unstacking devices 44 of this type are known in many designs in the printing industry as layer-ons. The application device 3 is controlled by the monitoring devices 15 and grasps the sheets 43, lacquers them and conveys them into the dryer 4. For the lacquering of individual sheets, the drying plate 18 beneath the radiators 20 (FIGS. 1, 3) is replaced by a conveyor belt 45 which supplies the sheets via a delivery roller 24 to a stacking magazine 46.

In the stacking magazine, the lacquered sheets 43 are placed in a stack again. This apparatus can also be provided with a multiple unstacking device 44 and several stacking magazines 46 for almost continuous operation. For this purpose, at least two timewise displaceable unstacking devices 44 and stacking magazines 46 are arranged next to each other.

We claim:

1. In an apparatus for strip-form material preparation by automatic initiation of lacquering of a surface of a strip of rollable material comprised of paper or film and subsequent drying the combination of an unwinding strip feed device, an application device for applying said lacquer, a dryer, and at least one winding-up device wherein said application device comprises an application roller and an opposing pressure roller means for holding said rollers in a separated position and thereby provide an opening for insertion of a leading end of said strip, means for insertion of said leading end into the application device and the opening to actuate a first control downstream of the rollers for the application of the lacquer, means actuated by said first control for initiating application of said lacquer to said strip by moving said rollers toward each other in contact with the strip, and whereby the rollers in contacting the strip grasp the strip and move it centered through said dryer and a guide device to winding up on a receiving spool in the windingup device.

2. An apparatus according to claim 1, characterized in that for the waste-free lacquering of the strip-form material, a monitoring device is arranged immediately downstream of the application device which causes the opposing pressure roller to be pressed against the application roller when the beginning of the strip-form material has just passed the application roller.

3. An apparatus according to claim 1, characterised in that for the centering and conveying of the strip-form material the opposing pressure roller of the application device is mounted in two individually movable arms and springs are provided on the arms to press the opposing pressure roller against the application roller and in that a lifting magnet is provided and can be controlled by the monitoring device which keeps the rollers apart for the introduction of the strip-form material.

4. An apparatus according to claim 1, characterised in that for the drying and curing of the lacquer ultraviolet radiators are arranged in a radiator housing above a drying plate on which the strip-form material is pushed and in that a radiation shutter is provided on the radiator housing which is pivotal to a greater or lesser extent between the strip-form material and the radiator depending on the speed of the strip-form material and keeps the radiation away from the strip-form material during a stoppage.

5. An apparatus according to claim 1, characterised in that guide plates are arranged downstream of the dryer to supply the strip-form material to a centering roller and in that the centering roller simultaneously acts as an opposing roller for a pressure mechanism for a rear pressure on the unlacquered side of the strip-form material.

6. An apparatus according to claim 1, characterised in that the receiving spool is a collecting spool is provided for winding up the lacquered and dried strip-form material and in that the collecting spool is provided with receiving springs arranged radially outward on the interiors of the flanges, the collecting spool being provided with receiving springs projecting radially toward the centre of the collecting spool increasingly toward the centre of the strip for the automatic grasping and guidance of the strip-form material round the core of the collecting spool.

7. An apparatus according to claim 6, characterised in that the winding up device is provided with two collecting spools for winding up the strip-form material and in that the collecting spools can be moved alternately into a winding up position and into a removal position by means of a change over device.

8. An apparatus according to claim 6, characterised in that two flanges of the guide roller, the centering roller and the collecting spool are adjustable in width from the centre out in both directions so that strip-form materials of various widths can be processed with one apparatus.

9. An apparatus according to claim 1, characterised in that the speed of lacquering can be selected within wide limits by altering the speed of the application device and the unwinding device is braked by a friction device and the winding up device is provided with its own frictional drive.

10. A method for automatic initiation of lacquering of strip-form materials comprising the steps of feeding a strip of material into a lacquer application device, inserting the leading end of the strip between a lacquer application roller and a pressure roller, said rollers being spaced apart in said application device actuating a lacquer initiating signal with said leading end to operate means moving said rollers together and applying lacquer to said strip surface and grasping said strip between said rollers and guiding the strip to drying and curing in a drier and then feeding the lacquered strip to a strip receiving spool and winding the strip in a roll on the spool.

* * * * *